US009555994B2

(12) United States Patent
Muto

(10) Patent No.: US 9,555,994 B2
(45) Date of Patent: Jan. 31, 2017

(54) IMAGE FORMING APPARATUS, METHOD OF CONTROLLING THE SAME, AND STORAGE MEDIUM

(71) Applicant: CANON KABUSHIKI KAISHA, Tokyo (JP)

(72) Inventor: Tsuyoshi Muto, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/019,166

(22) Filed: Feb. 9, 2016

(65) Prior Publication Data

US 2016/0252867 A1 Sep. 1, 2016

(30) Foreign Application Priority Data

Feb. 26, 2015 (JP) ..... 2015-037297

(51) Int. Cl.

*B65H 29/00* (2006.01)
*G03G 15/00* (2006.01)
*B65H 85/00* (2006.01)
*B65H 43/00* (2006.01)

(52) U.S. Cl.

CPC ..... *B65H 29/00* (2013.01); *B65H 43/00* (2013.01); *B65H 85/00* (2013.01); *G03G 15/6529* (2013.01)

(58) Field of Classification Search

CPC ..... B65H 29/00; B65H 43/00; B65H 85/00; G03G 2215/00928; G03G 15/23; G03G 15/232; G03G 15/234; G03G 15/235; G03G 15/6579; G03G 2215/0043; G03G 2215/00438; G03G 2215/00586;G03G 15/6529; H04N 1/00572; H04N 1/00575; H04N 1/00578; H04N 1/0058; H04N 1/00583; H04N 1/00586

USPC ..... 271/65; 399/364, 374, 401

See application file for complete search history.

(56) References Cited

U.S. PATENT DOCUMENTS

| | | | | |
|---|---|---|---|---|
| 7,481,427 | B2 * | 1/2009 | Tokutsu | B65H 3/00 271/176 |
| 8,390,857 | B2 | 3/2013 | Igarashi | |
| 8,493,585 | B2 | 7/2013 | Muto | |
| 8,520,249 | B2 | 8/2013 | Muto et al. | |
| 8,662,498 | B2 * | 3/2014 | Ito | B65H 31/02 271/163 |
| 8,797,567 | B2 | 8/2014 | Muto | |

(Continued)

FOREIGN PATENT DOCUMENTS

JP 2010-105350 A 5/2010

*Primary Examiner* — David H Bollinger
(74) *Attorney, Agent, or Firm* — Fitzpatrick, Cella, Harper & Scinto

(57) ABSTRACT

The image forming apparatus controls feeding of a paper to an image forming unit and re-feeding of a paper to the image forming unit by a re-feeding unit that re-feeds the paper held by a double-sided paper feed path. The apparatus changes a print setting of a paper that is the single-sided printing into a forcible double-sided printing that uses the double-sided paper feed path, if a paper whose print setting is double-sided printing and a paper whose print setting is single-sided printing are mixed in a print job, and if there is no paper held in the double-sided paper feed path and the print setting of a paper to be fed is the forcible double-sided printing, the apparatus changes the print setting of the paper to be fed into single-sided printing.

9 Claims, 6 Drawing Sheets

(56) References Cited

U.S. PATENT DOCUMENTS

| | | | | |
|---|---|---|---|---|
| 8,861,050 | B2 * | 10/2014 | Sahara | H04N 1/00591 271/126 |
| 2003/0020228 | A1 * | 1/2003 | Kobayashi | G03G 15/234 271/3.14 |
| 2007/0188794 | A1 * | 8/2007 | Matsui | B65H 5/00 358/1.15 |
| 2011/0290137 | A1 * | 12/2011 | Hatakeyama | B41J 3/60 101/483 |
| 2012/0120456 | A1 * | 5/2012 | Shiho | G06K 9/00442 358/448 |
| 2012/0133963 | A1 * | 5/2012 | Oshima | H04N 1/00572 358/1.12 |
| 2012/0243015 | A1 * | 9/2012 | Saida | G03G 15/231 358/1.12 |
| 2015/0239704 | A1 * | 8/2015 | Ooba | G03G 15/6582 493/405 |
| 2015/0283842 | A1 * | 10/2015 | Tachibana | B42B 2/02 412/6 |

* cited by examiner

IMAGE FORMING APPARATUS, METHOD OF CONTROLLING THE SAME, AND STORAGE MEDIUM

BACKGROUND OF THE INVENTION

Field of the Invention

The present invention relates to an image forming apparatus, a method of controlling the same and a storage medium.

Description of the Related Art

Conventionally, the following schemes exist as a print schedule for a case of printing print data in which image data for which double-sided printing is designated and image data for which single-sided printing is designated are mixed.

A first scheme switches double-sided printing and single-sided printing as designated by the print data. In this scheme, when double-sided printing and single-sided printing are switched, the conveyance path of paper is switched to a double-sided paper feed path (a paper feed path for double-sided printing) or a single-sided paper feed path.

In the double-sided printing which uses the double-sided paper feed path, a paper is conveyed to a transfer unit, and an image is printed on one side of the paper. Then, the paper whose one side is printed, is sent to a paper reversing unit to be reversed, the paper passes through the double-sided paper feed path and is once again sent to the transfer unit, and an image is transferred to the side opposite to the side of the paper first printed to, thereby realizing the double-sided printing to the paper. Furthermore, to improve the productivity by filling the interval between papers, when performing double-sided printing consecutively, rather than performing transfer to the first side and transfer to the a second side on the opposite side thereof for every paper, a plurality of papers are fed collectively, and images of the first side of these papers are consecutively printed. After this, the plurality of papers on the first sides of which an image is printed are sent to the double-sided paper feed path; a double-sided circulating control is performed wherein printing of an image of the first side of papers that are newly fed, and printing of an image on the second side of the papers conveyed via the double-sided paper feed path are alternatingly executed. By doing this, it is possible to print without interval between papers occurring in a case where double-sided printing is consecutive, which is therefore is efficient. However, if single-sided printing and double-sided printing are switched frequently, productivity is lowered because intervals between papers in the double-sided paper feed path are generated.

A second scheme solves this problem. In the second scheme, in order to reduce a lowering of productivity due to intervals between papers, printing is performed by causing papers for which only one side is printed to pass through the same conveyance path as the papers for which both sides are printed (for example, refer to Japanese Patent Laid-Open No. 2010-105350). In the second scheme, if an image for which single-sided printing is designated is printed during execution of double-sided printings, the image data corresponding to the back side of the image for which the single-sided printing is designated is converted to image data to be printed as blank sheet image data, and the paper is caused to pass through the double-sided paper feed path. With this, it is possible to print consecutively without generating intervals between papers.

In the foregoing conventional image forming apparatuses, there are cases that occur in which the generation of the subsequent image data does not keep up for the cycle of the double-sided circulating control due to time being required for print data analysis processing. Also, in cases where printing is temporarily interrupted by a paper jam or a paper outage, the cycle of the double-sided circulating control stops. When the reason for the stoppage is cancelled, and printing is restarted, the control to cause a paper on which head image data is to be printed to pass through the double-sided paper feed path is performed even in cases where the head image data is image data for which single-sided printing is designated. Accordingly, there is a problem in that the head image data is single-sided printing, and compared to a case in which the head image data is single-sided printed, productivity is lowered. Furthermore, by the foregoing conventional technique, there is a problem in that a paper of the single-sided printing is caused to pass through the double-sided paper feed path unnecessarily for printing the paper, and the consumption of parts of the conveying path is accelerated.

SUMMARY OF THE INVENTION

An aspect of the present invention is to eliminate the above-mentioned problems which are found in the conventional technology.

A feature of the present invention is to provide a technique for enhancing print efficiency in a case where papers for which a print setting is double-sided printing and papers for which a print setting is single-sided printing are mixed in a print job, and preventing a consumption of parts of a conveying path by eliminating unnecessary conveyance of papers.

According to a first aspect of the present invention, there is provided an image forming apparatus comprising: an image forming unit configured to form an image on a paper; a paper feed unit configured to feed a paper from a paper supplier to the image forming unit; a double-sided paper feed path configured to hold and convey a paper to form an image on a side that is opposite to a side of the paper on which an image has been formed; a re-feeding unit configured to re-feed the paper held by the double-sided paper feed path to the image forming unit; a control unit configured to control feeding of a paper to the image forming unit by the paper feed unit, and re-feeding of a paper to the image forming unit by the re-feeding unit; a setting unit configured to, in a case where a paper for which a print setting is double-sided printing and a paper for which a print setting is single-sided printing are mixed in a print job, change the print setting of the paper that is the single-sided printing to a forcible double-sided printing that uses the double-sided paper feed path; and a changing unit configured to, if there is no paper held in the double-sided paper feed path and the print setting of a paper to be fed is the forcible double-sided printing, change the print setting of the paper to be fed into single-sided printing.

According to a second aspect of the present invention, there is provided a method of controlling an image forming apparatus having an image forming unit configured to form an image on a paper, a paper feed unit configured to feed a paper from a paper supplier to the image forming unit, and a double-sided paper feed path configured to hold and convey a paper to form an image on a side that is opposite to a side of the paper on which an image has been formed, the method comprising: re-feeding a paper held by the double-sided paper feed path to the image forming unit; controlling feeding of a paper to the image forming unit by the paper feed unit and re-feeding of a paper to the image forming unit in the re-feeding step; changing the print setting of the paper that is the single-sided printing to a forcible double-sided printing that uses the double-sided paper feed path, in a case where a paper for which a print setting is double-sided printing and a paper for which a print setting is single-sided printing are mixed in a print job, and changing the print setting of the paper to be fed into single-sided printing, if there is no paper held in the double-sided paper feed path and the print setting of a paper to be fed is the forcible double-sided printing.

Further features and aspects of the present invention will become apparent from the following description of exemplary embodiments, with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE EMBODIMENTS

Embodiments of the present invention will be described hereinafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention.

Figure 1:
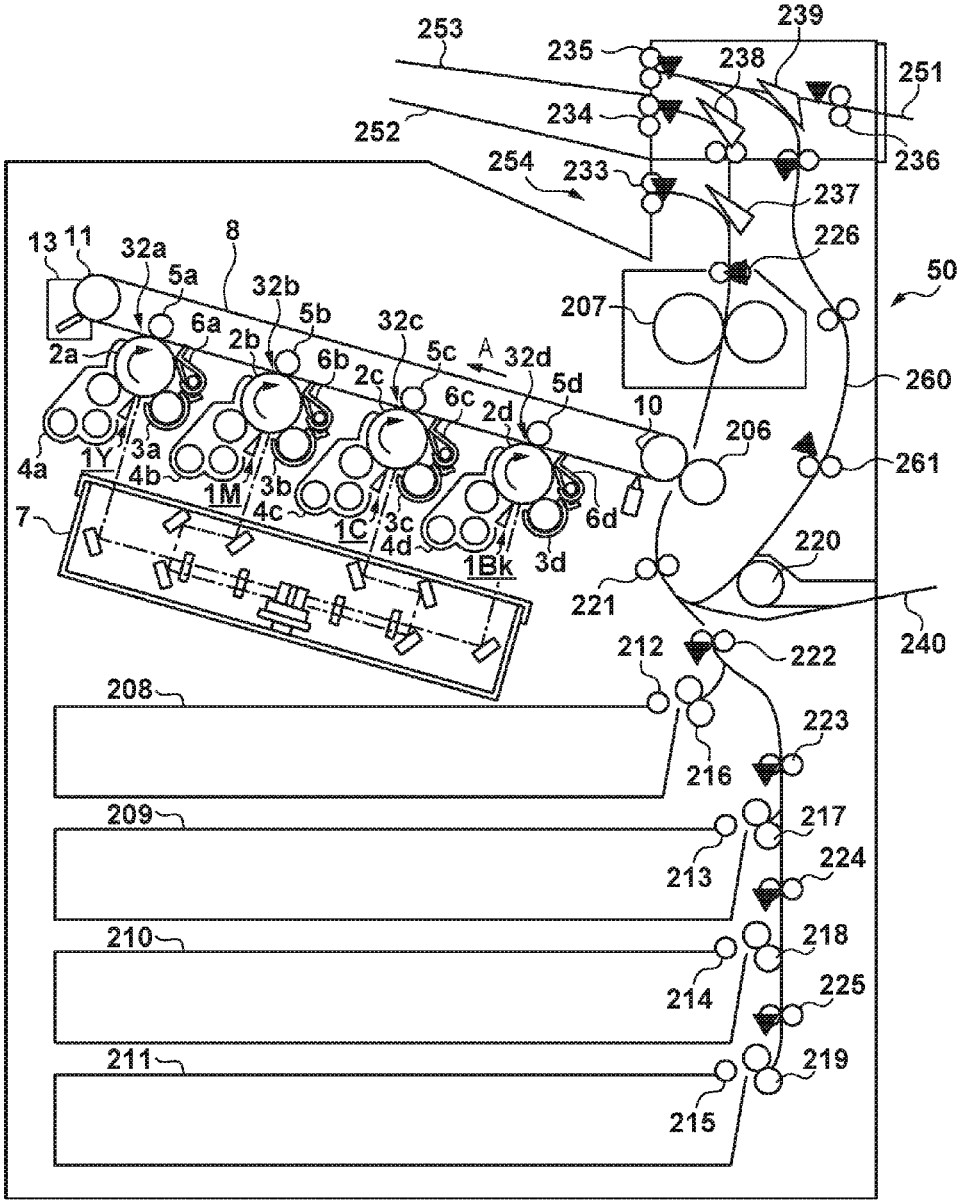
FIG. 1 depicts a view illustrating an overview configuration of a color printer unit of an image forming apparatus according to an embodiment of the present invention.

FIG. 1 depicts a view illustrating an overview configuration of a color printer unit 50 of an image forming apparatus according to the embodiment of the present invention.

The color printer unit 50 comprises 4 image forming units: an image forming unit 1Y for forming a yellow color image; an image forming unit 1M for forming a magenta color image; an image forming unit 1C for forming a cyan color image; an image forming unit 1Bk for forming a black color image. The image forming units 1Y-1Bk are arranged in a line in fixed intervals.

For each of the image forming units 1Y, 1M, 1C, and 1Bk, a drum-type electrophotographic photosensitive members (hereinafter referred to as photosensitive drum) 2*a*, 2*b*, 2*c*, and 2*d* are respectively arranged as an image carrier. Also in the periphery of the photosensitive drums 2*a*, 2*b*, 2*c*, and 2*d*, primary chargers 3*a*, 3*b*, 3*c*, and 3*d*, developing units 4*a*, 4*b*, 4*c*, and 4*d*, transfer rollers 5*a*, 5*b*, 5*c*, and 5*d*, and drum cleaners 6*a*, 6*b*, 6*c*, and 6*d* are arranged respectively.

On a lower side of the primary chargers 3*a*, 3*b*, 3*c*, and 3*d* and the developing units 4*a*, 4*b*, 4*c*, and 4*d*, a laser exposure unit 7 is arranged. In the developing units 4*a*, 4*b*, 4*c*, and 4*d* a yellow toner, a magenta toner, a cyan toner, and a black toner are stored respectively.

The photosensitive drums 2*a*, 2*b*, 2*c*, and 2*d* are driven to rotate at a predetermined process speed in an arrow symbol direction (clockwise in FIG. 1) by a driving apparatus (not shown). For the primary chargers 3*a*, 3*b*, 3*c*, and 3*d*, by a charge bias power source (not shown) applying a charge bias, the surfaces of the photosensitive drums 2*a*, 2*b*, 2*c*, and 2*d* are respectively charged uniformly to a predetermined potential of a negative polarity.

As described above, toners of four colors are respectively stored in the developing units 4*a*, 4*b*, 4*c*, and 4*d*. A toner image is developed (visualized) by causing toner of a corresponding color to adhere to the corresponding photosensitive drums 2*a*, 2*b*, 2*c*, and 2*d* with respect to an electrostatic latent image corresponding to image data of the respective color formed by the laser exposure unit 7.

The laser exposure unit 7 comprises a reflecting mirror, a polygon lens, and a laser oscillator or the like for performing a light emission corresponding to a chronological order electronic digital pixel signal of image data that is provided. The laser oscillator can change a laser power in 15 stages by switching a laser output electrical current.

The transfer rollers 5*a*, 5*b*, 5*c*, and 5*d* are arranged to be able to abut the photosensitive drums 2*a*, 2*b*, 2*c*, and 2*d* via an intermediate transfer belt 8 in respective primary transfer units 32*a*, 32*b*, 32*c*, and 32*d*. By the transfer rollers 5*a*, 5*b*, 5*c*, and 5*d*, toner images formed on each photosensitive drum are transferred to the intermediate transfer belt 8.

The drum cleaners 6*a*, 6*b*, 6*c*, and 6*d* comprise cleaning blades for removing from the photosensitive drums 2*a*, 2*b*, 2*c*, and 2*d* remaining transfer toner that remains on the photosensitive drums 2*a*, 2*b*, 2*c*, and 2*d* at the time of primary transfer, respectively.

The intermediate transfer belt 8 is arranged at an upper portion of the photosensitive drums 2*a*, 2*b*, 2*c*, and 2*d*, and is stretched between a secondary transfer opposing roller 10 and a tension roller 11, and is driven to move in an arrow symbol direction A (the counterclockwise direction in FIG. 1) by the secondary transfer opposing roller 10. The tension roller 11 is a roller for applying a tension to the intermediate transfer belt 8. Also, the secondary transfer opposing roller 10 is arranged to be able to abut a secondary transfer roller 206 via the intermediate transfer belt 8. A belt cleaning apparatus 13 is arranged on the outside of the intermediate transfer belt 8 in the vicinity of the tension roller 11. The belt cleaning apparatus 13 removes and collects remaining transfer toner that is left on the surface of the intermediate transfer belt 8 after secondary transferring.

A paper to which a toner image has been transferred in the secondary transfer position is conveyed to a fixing unit 207 arranged at an upper side of the secondary transfer position in a vertical path configuration, and toner is fixed to the paper by a fixing roller and a pressure roller.

Other configurations illustrated in FIG. 1 are explained using an image forming operation of an image forming apparatus 30.

When an image formation initiation signal is accepted, the photosensitive drums 2*a*, 2*b*, 2*c*, and 2*d* of the image forming units 1Y, 1M, 1C, and 1Bk are rotationally driven at a predetermined process speed. Then the photosensitive drums 2*a*, 2*b*, 2*c*, and 2*d* are respectively charged to a negative polarity uniformly by the corresponding primary chargers 3*a*, 3*b*, 3*c*, and 3*d*. After that, by the laser exposure unit 7, a laser beam that is modulated in accordance with the image signal of each color is outputted by the laser oscillator in synchronism with an image signal that is input from a control unit 100 (FIG. 2A) and for which color decomposition is performed. Laser beams outputted in this way respectively irradiate the photosensitive drums 2*a*, 2*b*, 2*c*, and 2*d* via polygon lenses, reflecting mirrors, or the like, and respectively form electrostatic latent images corresponding to the image data of four colors on the respective photosensitive drums 2*a*, 2*b*, 2*c*, and 2*d*.

Next, with respect to the electrostatic latent image formed on the photosensitive drum 2*a* firstly, a toner image of the yellow color is visualized by the developing unit 4*a* adhering yellow toner to which the same polarity as the charging polarity (a negative polarity) of the photosensitive drum 2*a* is applied. The toner image of the yellow color thus visualized is transferred (a primary transfer) onto the intermediate transfer belt 8 by the transfer roller 5*a* to which a primary transfer bias (a positive polarity of the opposite polarity to the toner) is applied in the primary transfer unit 32*a*. The intermediate transfer belt 8 is driven after that as well, and a region to which the toner image of the yellow color on the intermediate transfer belt 8 has been transferred is moved to the image forming unit 1M.

In the image forming unit 1M, similarly to the yellow color in the image forming unit 1Y, the toner of the magenta color is visualized, and a toner image of the magenta color is transferred to the intermediate transfer belt 8 so as to overlap the toner image of the yellow color in the primary transfer unit 32*b*.

Thereafter similarly toner images of the cyan color in the primary transfer unit 32*c* and the black color in the primary transfer unit 32*d* are transferred so that everything overlaps, and thereby a full color toner image is formed on the intermediate transfer belt 8.

Also, remaining transfer toners, which are left on the photosensitive drums 2*a*, 2*b*, 2*c*, and 2*d* without being transferred, are respectively scraped off of the photosensitive drum faces by the cleaner blades in the drum cleaners 6*a*, 6*b*, 6*c*, and 6*d* and collected.

Meanwhile, a paper is first picked up by one of pick-up rollers 212, 213, 214, and 215 corresponding to a respective cassette tray among an upper cassette 208, a lower cassette 209, a third stage cassette 210 and a fourth stage cassette 211 which are paper feed units. The paper is fed by one of paper feed rollers 216, 217, 218, and 219 of the cassette trays, and is conveyed to a registration roller 221 by vertical path conveyance rollers 222, 223, 224 and 225.

In the case of a manual feed which is another paper feed unit, one paper is separated by a manual feed roller 220 from a paper bundle stacked on a manual feed tray 240, and conveyed until the registration roller 221 as is.

The registration roller 221 initiates conveyance so that the toner image on the intermediate transfer belt 8 exactly overlaps the paper at the position of the secondary transfer roller 206 in synchronism with the timing at which time the transferring to the intermediate transfer belt 8 ends. Then, while being conveyed in a direction of the fixing unit 207 while sandwiched between the secondary transfer roller 206 and the intermediate transfer belt 8, the paper is pressure bonded to the intermediate transfer belt 8 by the secondary transfer roller 206, and the toner image on the intermediate transfer belt 8 is transferred (secondary transfer) to the paper. In this way, the paper to which the toner image has been secondary transferred is conveyed to the fixing unit 207, and in the fixing unit 207 the toner image is fused and pressurized to fix it to the face of the paper. A post-fixing sensor 226 detects the conveyance of the paper after the fixing.

When the paper to which the toner image has been fixed is discharged to a first discharge orifice 254, the paper is guided to a first discharge roller 233 by switching a first discharge flapper 237 to the direction of the first discharge roller 233, and is discharged to the first discharge orifice 254. Also, when discharging the paper to a second discharge orifice 252, the paper is guided to a second discharge roller 234 by switching the first discharge flapper 237 and a second discharge flapper 238 to the direction of the second discharge roller 234, and is discharged to the second discharge orifice 252.

Also, when discharging the paper to a third discharge orifice 251, first the paper is guided to a reversing roller 235 by switching the first discharge flapper 237 and the second discharge flapper 238 to the direction of the reversing roller 235. Then, by the reversing roller 235, the paper is first conveyed in an outer direction of the image forming apparatus, and the conveyance of the paper is temporarily stopped prior to the trailing edge of the paper leaving the reversing roller 235. Next, by inverting the rotation direction of the reversing roller 235, the paper is conveyed in the direction of the third discharge orifice 251 along the conveyance path. Accordingly, by switching a third discharge flapper 239 to the direction of a third discharge roller 236, it is possible to guide the paper to the third discharge roller 236, and as a result, the paper is discharged to the third discharge orifice 251.

When performing double-sided printing, a paper, to which a toner image corresponding to the back side of the original has been fixed, is conveyed until the reversing roller 235. After that, the rotation direction of the reversing roller 235 is inverted, and the paper is conveyed in the opposite direction. After this, by switching the third discharge flapper 239 to a direction of a double-sided path (double-sided paper feed path) 260, the paper, on the back side of which the image has been formed, is conveyed to the double-sided path 260. In the double-sided path 260, the paper is conveyed to the registration roller 221 by the rotation of a double-sided feed roller 261, and after that transfer/fixing of the image to the front side of the paper is executed. The paper, whose front side the image is fixed in this way, is discharged to either the first discharge orifice 254, the second discharge orifice 252, or the third discharge orifice 251 in accordance with a discharge setting.

A remaining paper discharge orifice 253 is used when discharging the remaining papers in the device, and here papers are discharged by the rotation of the reversing roller 235.

Figure 2A:
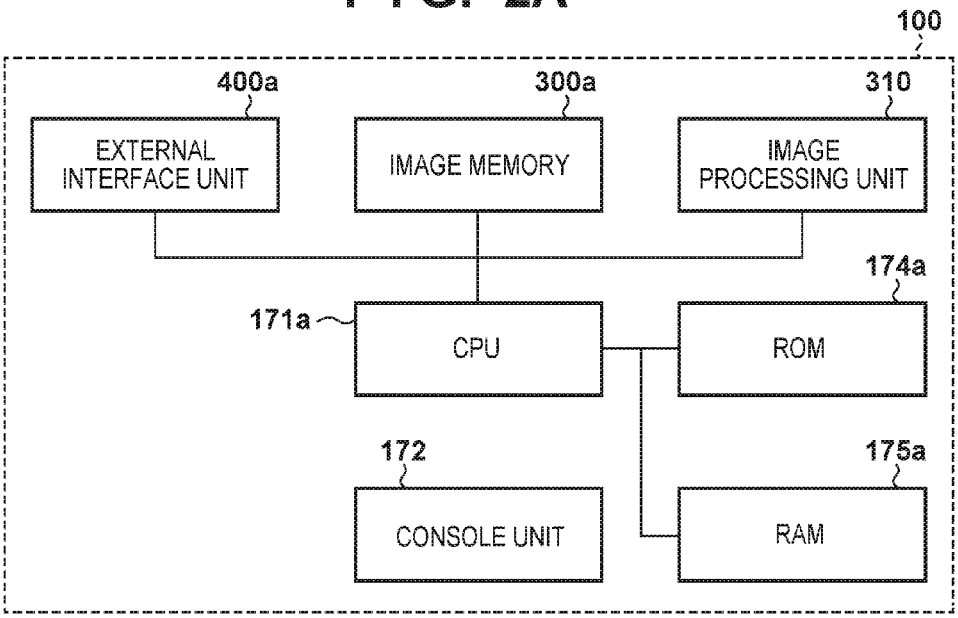
FIG. 2A is a block diagram for describing a configuration of a control unit for controlling an operation of the image forming apparatus according to the embodiment.
Figure 2B:
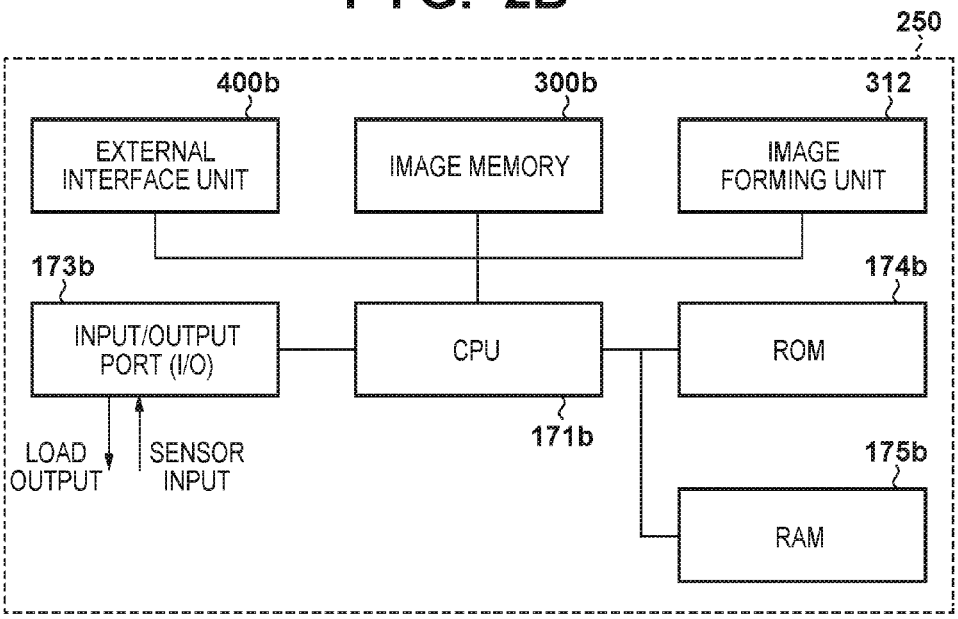
FIG. 2B is a block diagram for describing a configuration of a printer control unit for controlling the color printer unit.

FIGS. 2A and 2B are block diagrams for describing a configuration of each control unit of the image forming apparatus according to the embodiment; FIG. 2A depicts a view foe describing a configuration of the control unit 100 which controls overall operation of the image forming apparatus, and FIG. 2B depicts a view for describing a configuration of a printer control unit 250 which controls the color printer unit 50 of FIG. 1.

The control unit 100 controls the overall operation of the image forming apparatus by communicating states and commands between an image processing unit 310 and the printer control unit 250. The printer control unit 250 receives instructions from the control unit 100 and controls print operation.

Below explanation is given in detail. The control unit 100 obtains print data through an external interface unit 400*a*, converts that print data into image data that the printer control unit 250 can print, and temporarily stores the image data in an image memory 300*a* of the control unit 100. After that, the control unit 100, in accordance with a reference timing signal from the printer control unit 250, executes an image forming operation by transmitting image data of the image memory 300*a* to the printer control unit 250 as an image data signal in synchronism with a video clock. The control unit 100 and the printer control unit 250 are explained in detail later.

In FIG. 2A, the control unit 100 includes a CPU 171*a*, a console unit 172, a ROM 174*a*, a RAM 175*a*, the external interface unit 400*a*, the image memory 300*a*, and the image processing unit 310, and these are connected via a bus.

The CPU 171*a* controls the control unit 100. In the ROM 174*a*, programs corresponding to control by the control unit 100 that are executed by the CPU 171*a* are stored. The RAM 175*a* is used as a work area for when the CPU 171*a* executes processing. The console unit 172 includes a display unit for presenting information to a user, and a key input unit that the user operates. The user can perform operations for switching an image forming operation mode and the display content of the display unit by the key input unit. Note that the display unit may comprise a touch panel function. By this operation, the CPU 171*a* displays to the display unit of the console unit 172 a state of the image forming apparatus based on the state of the color printer unit 50 obtained by the printer control unit 250.

The external interface unit 400*a* transmits/receives image data and processing data with an external device such as a PC. Furthermore, the external interface unit 400*a* transmits an image data signal to the printer control unit 250. In the image memory 300*a*, image data is stored. The image processing unit 310 executes image processing such as compression/decompression processing and density adjustment processing on image data stored in the image memory 300*a*.

In FIG. 2B, the printer control unit 250 includes a CPU 171*b*, a ROM 174*b*, a RAM 175*b*, an external interface unit 400*b*, an image memory 300*b*, an image forming unit 312, and an input/output port (I/O) 173*b*, and these are connected via a bus. The CPU 171*b* controls operation of the printer control unit 250. In the ROM 174*b*, programs corresponding to printer control executed by the CPU 171*b* are stored. The RAM 175*b* is used as a work area for when the CPU 171*b* executes processing. Connected to the input/output port 173*b* is an input device, such as a sensor for detecting various loads such as a clutch and a motor for controlling operation of the color printer unit 50, or the position of a paper. Furthermore, the external interface unit 400*b* receives an image data signal from the control unit 100.

The image forming units 1Y, 1M, 1C, and 1Bk are collectively expressed by the image forming unit 312. The image forming unit 312 synchronizes with a paper conveyance operation performed by processing of the input/output port 173*b*, and performs processing for exposure by emitting laser beams by the laser exposure unit 7 based on a received image data signals.

FIGS. 3A through 3F depict views for describing a movement of a paper in a conveying path in a case where an image is formed on both sides of a paper P in the image forming apparatus according to the embodiment. In FIGS. 3A-3F, the paper P on which no image is formed on either side is illustrated by a broken line P1, and the paper P on which an image is formed only on one side (the back side) is illustrated by a dotted line P2, and the paper P on which images are formed on both sides is illustrated by a thick solid line P3.

Figure 3A:
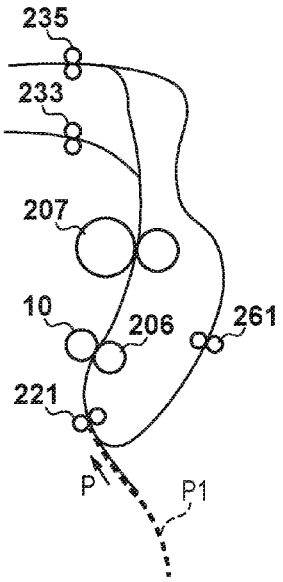
FIGS. 3A-3F depict views for describing a movement of a paper in a conveying path in a case where an image is formed on both sides of a paper in an image forming apparatus according to the embodiment.

FIG. 3A depicts a view illustrating the paper P at a point in time at which it has been fed to reach the registration roller 221. The paper P illustrated by the broken line P1 is conveyed so that the toner image transferred to the intermediate transfer belt 8 is transferred to the paper P at a position of the secondary transfer roller 206.

Figure 3B:
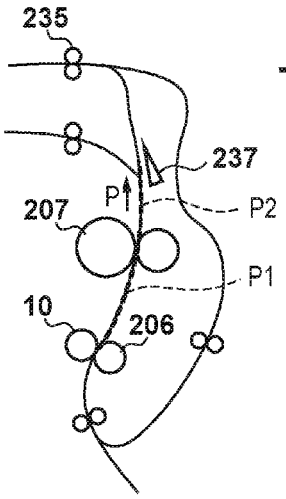

FIG. 3B depicts a view illustrating, by the dotted line P2, the paper P to the back side of which an image has been transferred by the secondary transfer opposing roller 10 and the secondary transfer roller 206, and a state in which half of the paper P has been fixed by the fixing unit 207. Here, by the direction of the first discharge flapper 237, the paper P is conveyed towards the reversing roller 235.

Figure 3C:
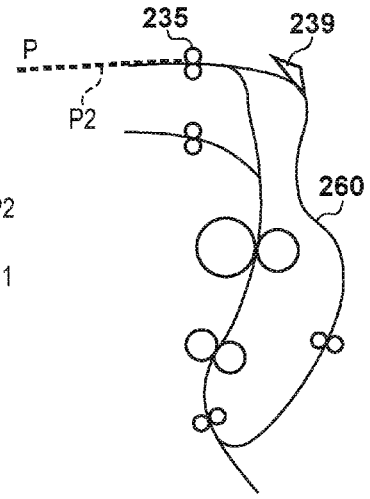

FIG. 3C depicts a view illustrating a state in which the paper P, illustrated by the dotted line P2 and on which an image has been only formed on the back side, is sandwiched by the reversing roller 235 and stopped. From here, the direction of the third discharge flapper 239 is switched to the double-sided path 260 side, and the paper P illustrated by the dotted line P2 is conveyed to the double-sided path 260 by inverting the rotation direction of the reversing roller 235.

Figure 3D:
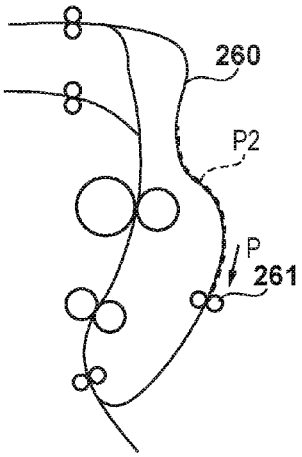

FIG. 3D depicts a view illustrating a state in which the paper P, illustrated by the dotted line P2 and on which an image is only formed on the back side, has been conveyed to the double-sided path 260 and has reached the double-sided feed roller 261.

Figure 3E:
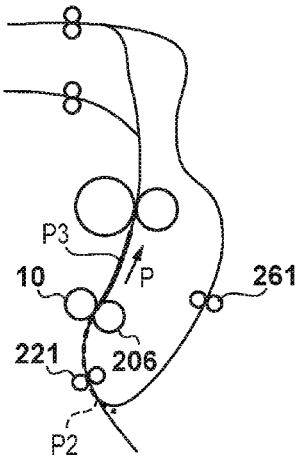

FIG. 3E depicts a view illustrating a state in which the paper P illustrated by the dotted line P2 and on which an image has been only formed on the back side is re-fed by the double-sided feed roller 261; an image is being transferred to the surface on the opposite side to the side of the paper P on which the image is already formed while it is being conveyed by the registration roller 221.

Figure 3F:
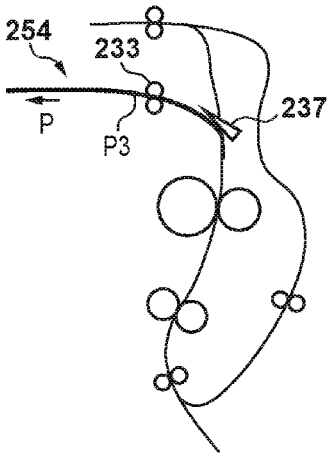

FIG. 3F depicts a view illustrating the paper P which is indicated by the thick solid line P3; images are formed on both sides of the paper P, which is discharged to the first discharge orifice 254 by the first discharge flapper 237 and the first discharge roller 233.

In FIGS. 3A-3F, a paper movement in a case of the single paper P is illustrated, but the operation essentially does not change in the case of a plurality of papers. However, the case of a plurality of papers differs in that conveyance is controlled so that the formation of an image on the back side of a paper fed from the cassette and the formation of an image on the front side of a paper fed from the double-sided path 260 side are performed alternatingly.

Figure 4:
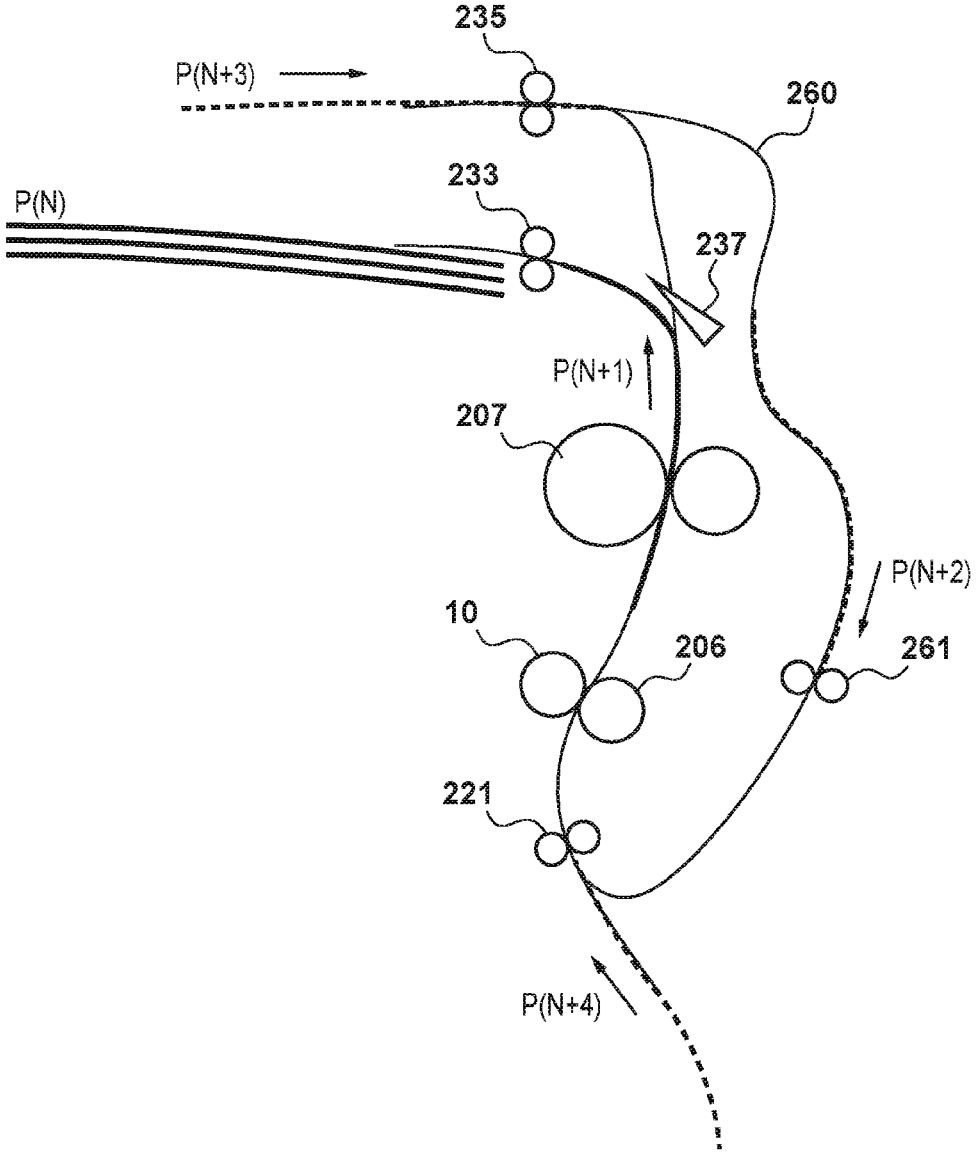
FIG. 4 depicts a view for describing a paper in a conveying path in a case where an image is formed on both sides of a plurality of papers in the image forming apparatus according to the embodiment.

FIG. 4 depicts a view for describing papers in a conveying path in a case where an image is formed on both sides of a plurality of papers P in the image forming apparatus according to the embodiment.

FIG. 4 illustrates a paper P(N) on which images have been formed on both sides and which has been discharged. A paper P(N+1) illustrates a paper on which a formed image is being fixed, and which is the paper that is discharged next to the paper P(N). A paper P(N+2) is a paper that is awaiting re-feeding at the position of the double-sided feed roller 261. A paper P(N+3) is sandwiched by the reversing roller 235 and is stopped. Note that images have been respectively formed on the back sides of the paper P(N+2) and the paper P(N+3), and images are next respectively formed on the front side of the papers P(N+2) and P(N+3). A paper P(N+4) which is fed from the cassette tray and on which an image is yet to be formed is waiting in the registration roller 221. Note that the order of the image formation of papers P(N−2)-P(N+4) is P(N) back, P(N−2) front, P(N+1) back, P(N−1) front, P(N+2) back, P(N) front, P(N+3) back, P (N+1) front, P(N+4) back, P(N+2) front and so on. In other words, when an image is formed on the back side of a particular paper, next formation of an image to the front side of a paper forward located by two papers to the particular paper is executed.

Regarding the first few papers that initiate the double-sided circulation, after an image is formed on the back side of a paper P(L), an image is formed on the back side of a paper P(L+1) at an interval of 1 paper, and after that an image is formed on the back side of a paper P(L+2) at an interval of 1 paper. After that, images are respectively formed in the order of P(L) front, P(L+3) back, P(L+1) front, P(L+4) back, P(L+2) front and so on. Also, if the number of papers is M, for the final few papers where the double-sided circulation stops, after image formation is performed in the order of the back side of the paper P(M) and then the front side of the paper P(M−2), an image is formed on the front side of the paper P(M−1) at an interval of 1 paper. Also, an image is further formed on the front side of the paper P(M) at an interval of 1 paper.

As described above, in double-sided printing (a double-sided image formation process), a predetermined number of papers are fed consecutively from the cassette, and after that, re-feeding from the double-sided feed roller 261 of the papers for which one side is already printed, and feeding from the cassette is repeated alternatingly. Then, finally, the re-feeding from the double-sided feed roller 261 is performed consecutively for a predetermined number of papers. Note that the number of papers fed consecutively from the cassette firstly is set in advance in accordance with the number of locations at which papers on which an image is formed on one side temporarily stop, the length of the papers, and the length of the conveyance path. Note that feeding and re-feeding when double-sided printing is controlled by the CPU 171*b*.

Table 1 illustrates an example of print data. Here, image data for 10 pages is illustrated, and it is designated so that double-sided printing is performed for all of the pages.

TABLE 1

| PAGE NUMBER | 1 | 2 | 3 | 4 | 5 | 6 | 7 | 8 | 9 | 10 |
|---|---|---|---|---|---|---|---|---|---|---|
| SINGLE-SIDED/ DOUBLE-SIDED DESIGNATION | DOUBLE-SIDED | DOUBLE-SIDED | DOUBLE-SIDED | DOUBLE-SIDED | DOUBLE-SIDED | DOUBLE-SIDED | DOUBLE-SIDED | DOUBLE-SIDED | DOUBLE-SIDED | DOUBLE-SIDED |

Table 2 illustrates an example of a print schedule in a case where the print data illustrated in Table 1 is printed by the image forming apparatus according to the embodiment. Here, printing of 10 pages worth of image data is performed on both sides of 5 papers in this page order. For example, a conveyance timing 1 illustrates feeding a paper with the first number 1 from any of cassettes 208-211 or the manual feed tray 240, and forming an image of a second page of the print data on the back side of the paper of the number 1. Also, a conveyance timing 6 illustrates re-feeding the paper of number 1 on which the second page image is formed on the back side, and forming an image of the first page of print data on the front side of the paper of the number 1. Also, a conveyance timing 2, a conveyance timing 4, a conveyance timing 11, and a conveyance timing 13 illustrate at an interval of 1 paper.

TABLE 2

| CONVEYANCE TIMING | | 1 | 2 | 3 | 4 | 5 | 6 | 7 | 8 | 9 | 10 | 11 | 12 | 13 | 14 |
|---|---|---|---|---|---|---|---|---|---|---|---|---|---|---|---|
| FEEDING | PAPER NUMBER | 1 | | 2 | | 3 | | 4 | | 5 | | | | | |
| | PRINT SIDE | BACK | | BACK | | BACK | | BACK | | BACK | | | | | |
| | PAGE NUMBER | 2 | | 4 | | 6 | | 8 | | 10 | | | | | |
| RE-FEEDING | PAPER NUMBER | | | | | | 1 | | 2 | | 3 | | 4 | | 5 |
| | PRINT SIDE | | | | | | FRONT | | FRONT | | FRONT | | FRONT | | FRONT |
| | PAGE NUMBER | | | | | | 1 | | 2 | | 3 | | 4 | | 5 |

Here, when images are formed on the back sides of the papers of the numbers 1-3 respectively, and they are in a standby state being held in the conveying path 260, before the paper of the number 4 is fed next, the paper of the number 1 at the head of the papers that has an image formed on its back side and is held in the conveying path 260 is re-fed. Then, an image according to the print data of page 1 is formed on the front side of the re-fed paper of the number 1. Next, the paper of the number 4 is fed, and an image according to the print data of the eighth page is formed on its back side, and it is conveyed to a standby position; subsequently, the paper of the number 2 at the head of the conveying path 260 to which an image is formed on the back side is re-fed, and an image is formed according to the print data of the second page on the front side of the paper of the number 2. Next, the paper of the number 5 is fed, and an image according to the print data of the tenth page is formed on its back side, and it is conveyed to a standby position; subsequently, the paper of the number 3 at the head of the conveying path 260 to which an image is formed on the back side is re-fed, and an image is formed according to the print data of the third page on the front side of the paper of the number 3. After this, there are no papers that are newly fed, and so the papers of the numbers 3-5 that are waiting in the conveying path 260 for re-feeding are conveyed sequentially to the transfer position, and images of the third page-the fifth page are respectively formed on the front sides thereof.

Figure 5:
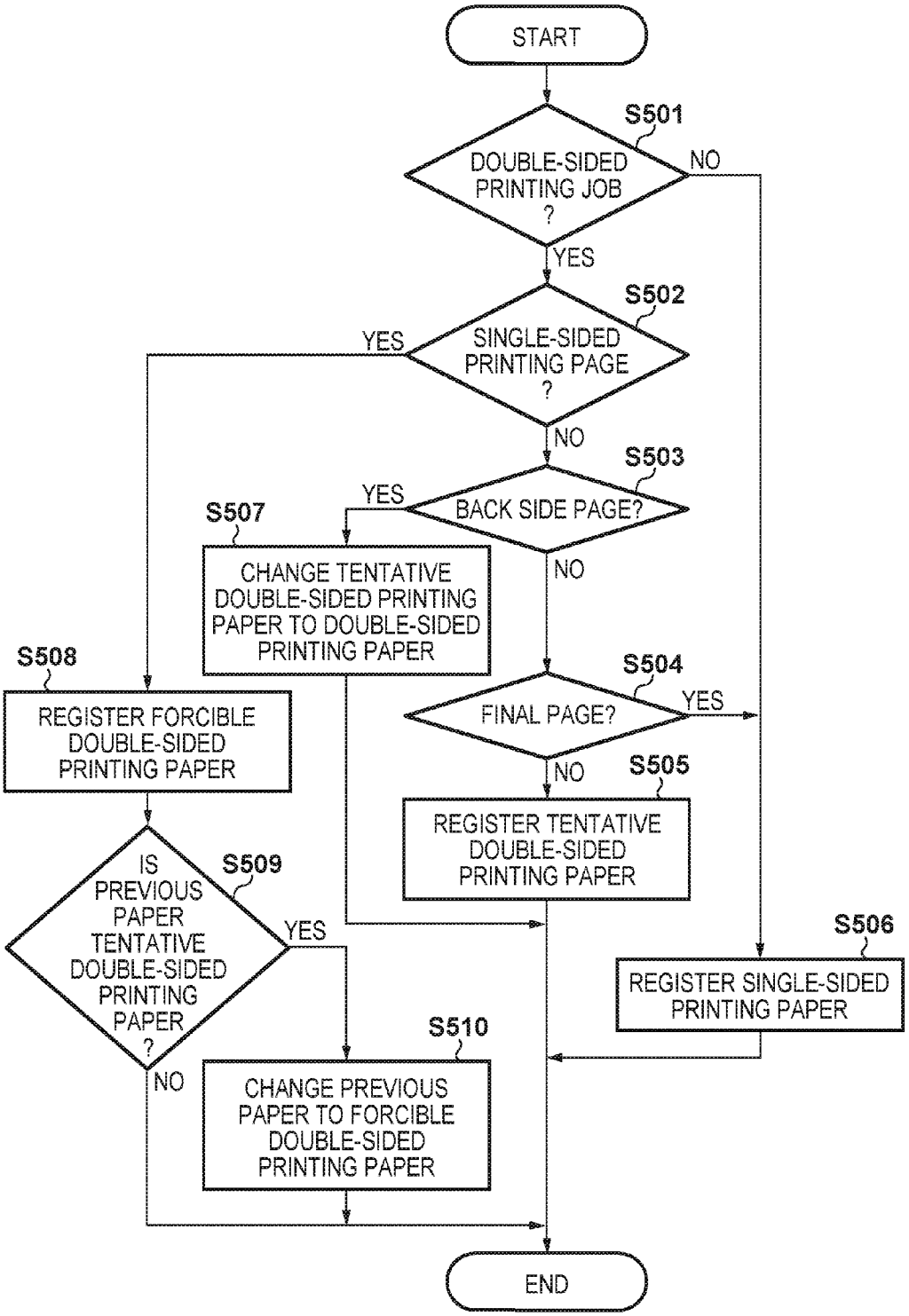
FIG. 5 is a flowchart for describing processing for registering a print setting for a paper in a paper feed wait queue (Table 3) in an image forming apparatus according to the embodiment.

FIG. 5 is a flowchart for describing processing for registering a print setting for a paper in a paper feed wait queue (Table 3) in an image forming apparatus according to the embodiment. Note that, a program that executes this process is stored on the ROM 174*a*, and at the time of execution the program is deployed into the RAM 175*a* and executed under the control of the CPU 171*a*. This processing is executed every time print data that the control unit 100 obtains via the external interface unit 400*a* is converted into 1 page worth of image data that is printable by the printer control unit 250.

Firstly, in step S501, the CPU 171*a* determines whether or not print data setting on the whole is double-sided printing. Here, when the print data setting on the whole is double-sided printing, the processing advances to step S502; otherwise the processing advances step S506. In step S506, the CPU 171*a* registers a single-sided printing paper in the paper feed wait queue, and terminates this processing.

In step S502, the CPU 171*a* determines whether or not print data setting of the current page is single-sided printing. When it is determined that the setting is single-sided printing, the processing proceeds to step S508, and when it is determined not to be single-sided printing, the processing advances to step S503. The case in which the processing proceeds to step S508 is the case of the print data of the fifth page in Table 4 which is explained later, for example. In step S508, the CPU 171*a* registers a forcible double-sided printing paper in the paper feed wait queue, and the processing advances to step S509. In step S509, the CPU 171*a* determines whether or not the tentative double-sided printing paper is registered in the paper feed wait queue by processing of the print data previous to this print data of the current page. Here, if the tentative double-sided printing paper is not registered, the processing is terminated as is, but if the tentative double-sided printing paper is registered, the processing proceeds to step S510, and the CPU 171*a* changes the tentative double-sided printing paper registered in the paper feed wait queue into a forcible double-sided printing paper, and terminates this processing. Note that if step S510 is executed, there are cases in which in spite of the fact that the previous page is double-sided printing, there is only print data for its front side. Accordingly, it is necessary to change settings of the previous paper to the forcible double-sided printing paper in this case.

Also, in step S502, when the setting of the print data of the current page is not single-sided printing, the processing proceeds to step S503, the CPU 171*a* determines whether or not the print data of the current page is to be printed on a back side of a paper. If it is to be printed on the back side, the processing proceeds to step S507, and if not to be printed on the back side, the processing advances to step S504. The case of being printed on the back side here is a case in which the paper is registered as tentative double-sided printing to a paper feed wait queue by processing of the print data of the time previous to the print data of the current page, that is a case in which the print data of the front side of the paper exists. In step S507, the CPU 171*a* changes the tentative double-sided printing paper registered in the paper feed wait queue to double-sided printing paper, and terminates this processing. With this, an image according to the print data of the back side is formed on the back side of the paper, the paper is re-fed via the double-sided path 260, and an image according to the print data of the front side is formed on the front side of the paper.

In step S504, the CPU 171*a* determines whether or not the print data is the final page, and if it is, the processing proceeds to step S506, and the CPU 171*a* registers single-sided printing paper in the paper feed wait queue, and terminates this processing. Meanwhile, if it is determined that it is not the final page in step S504, the processing proceeds to step S505, and the CPU 171*a* registers forcible double-sided printing paper to the paper feed wait queue, and terminates this processing. With this, even if an odd page is the final page, the final paper is single-sided printed and discharged.

By the foregoing processing, in a case where for print data of a front side, the paper thereof is registered as tentative double-sided printing paper, the paper registered as the tentative double-sided printing paper is registered as a double-sided printing paper in the case of print data of a back side. If the final page is print data of a front side, the paper thereof is registered as a single-sided printing paper. Furthermore, configuration is taken such that if a single-sided printing page is included, a paper of that time is registered as a forcible double-sided printing paper, and a blank image is printed on the back side thereof.

Table 3 illustrates an example of a paper feed wait queue saved in the RAM 175*a* of the control unit 100. This illustrates a state of storing a paper setting for when image data of the seventh page of the print data illustrated in Table 1 is processed, and step S505 of FIG. 5 is executed.

TABLE 3

| FEED QUEUE NUMBER | 1 | 2 | 3 | 4 | 5 | 6 | 7 | 8 |
|---|---|---|---|---|---|---|---|---|
| PAPER NUMBER | 1 | 2 | 3 | 4 | | | | |
| FRONT PAGE | 1 | 3 | 5 | 7 | | | | |
| BACK PAGE | 2 | 4 | 6 | | | | | |
| SINGLE-SIDED/ DOUBLE-SIDED DESIGNATION | DOUBLE-SIDED | DOUBLE-SIDED | DOUBLE-SIDED | TENTATIVE DOUBLE-SIDED | | | | |

In Table 3, a feed queue number 1 illustrates a paper fed first. For example, it is illustrated that the paper number of the paper of the feed queue number 1 is 1, an image of the first page of print data is formed on the front side, and double-sided printing for forming an image of the second page on the back side is performed. Similarly, for feed queue numbers 2 and 2, the images of the third and fourth pages are formed on both sides of the paper of the number 2, the images of the fifth and sixth pages are formed on both sides of the paper of the number 3.

Here, the CPU 171*a* causes the feed queue number in the settings of the registered papers from the feed queue number 2 onward to respectively shift in the queue to be 1 smaller when the paper of the number 1 in the paper feed wait queue is fed. Also, in a case where the CPU 171*a* registers a paper newly, the CPU 171*a* registers it as the number following the final feed queue number with which a paper is registered in the paper feed wait queue.

Figure 6:
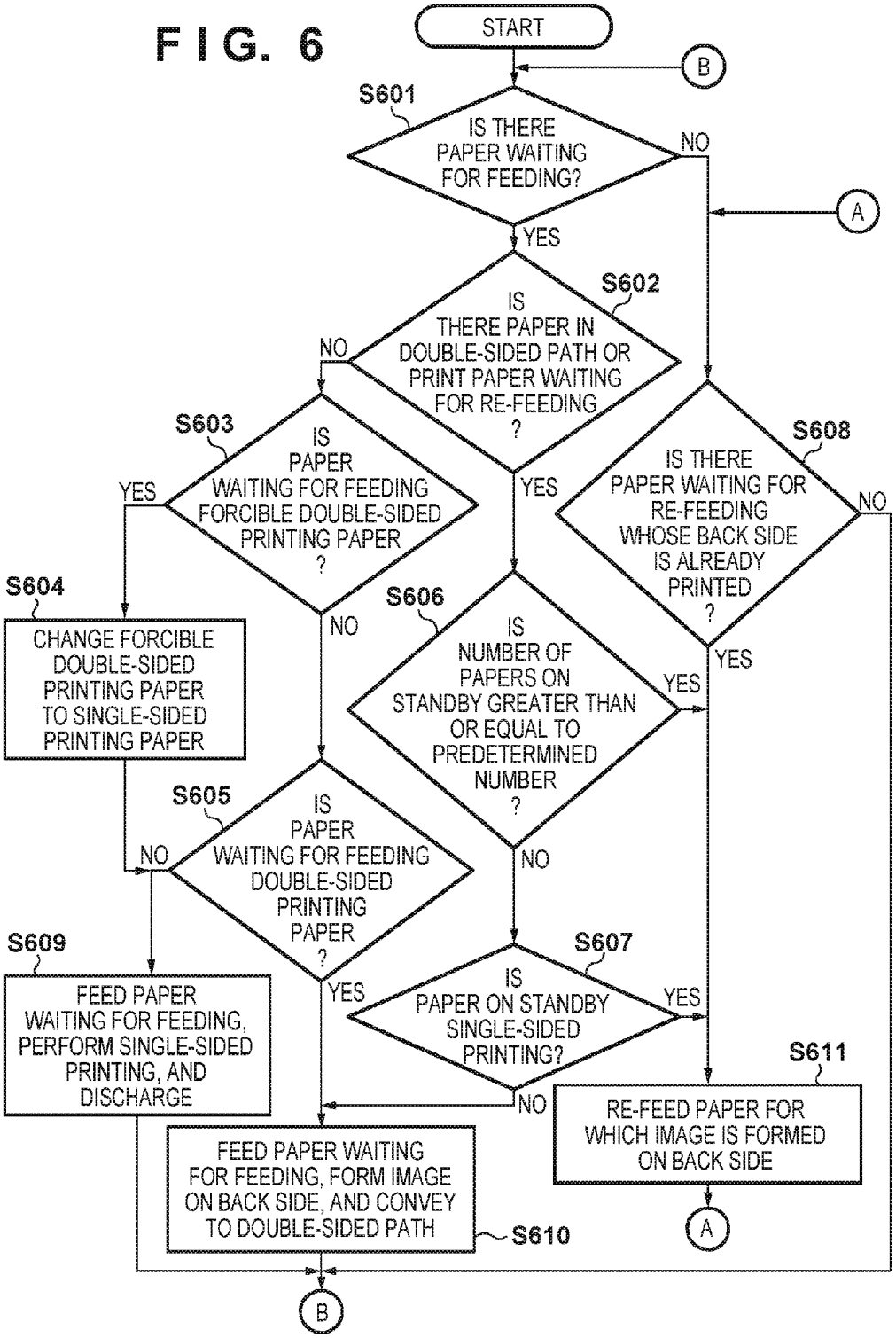
FIG. 6 is a flowchart for describing control for conveying papers in the image forming apparatus according to the embodiment.

FIG. 6 is a flowchart for describing control for conveying papers in the image forming apparatus according to the embodiment. Note that, a program that executes this process is stored on the ROM 174*a*, and at the time of execution the program is deployed into the RAM 175*a* and executed under the control of the CPU 171*a*.

Firstly, in step S601, the CPU 171*a* determines whether or not a setting of a paper is registered in the paper feed wait queue, that is whether or not there is a paper waiting for feeding from the cassette, or the like. If there is a paper waiting for feeding, the processing proceeds to step S602; if there is no paper waiting for feeding, the processing proceeds to step S608. In step S608, the CPU 171*a* determines whether or not there exists a paper waiting for re-feeding in the double-sided path 260 whose back side is already printed. If it is determined that such a paper exists, the processing proceeds to step S611; it is determined that such a paper does not exist, the processing proceeds to step S601. In step S611, the CPU 171*a* re-feeds the paper awaiting re-feeding which is on standby in the double-sided path 260 to the position of the secondary transfer roller 206, and makes an instruction to the printer control unit 250 to discharge to one of the discharge orifices 252, 253, and 254, and the processing proceeds to step S608.

With this, if there is no paper waiting for feeding and when there ceases to be any papers awaiting feeding such as at the conveyance timings 12 or 14 of Table 2 or at the conveyance timings 13 or 15 of Table 6, for example, papers awaiting re-feeding in the double-sided path 260 are conveyed sequentially to the transfer position, an image is formed on the front side thereof, and they are discharged.

In step S602, the CPU 171*a* determines whether or not there exists a paper in the double-sided path 260 or a paper waiting for re-feeding. If such a paper is determined to exist, the processing proceeds to step S606, and the CPU 171*a* determines whether or not the number of papers in the double-sided path 260, or papers waiting for re-feeding is greater than or equal to a predetermined number of papers (3 papers in the case of the image forming apparatus of the configuration of FIGS. 3A-3F and FIG. 4). If it is determined that the number of papers is greater than or equal to the predetermined number of papers, the processing proceeds to step S611, and as previously explained, the CPU 171*a* re-feeds to the position of the secondary transfer roller 206 prioritizing the paper at the head that is awaiting re-feeding and is in standby in the double-sided path 260.

Meanwhile, when, in step S606, it is determined that the number of papers on the double-sided path 260, or papers that are awaiting re-feeding is not greater than or equal to the predetermined number of papers, the processing proceeds to step S607, and the CPU 171*a* determines whether or not the setting of the papers on standby waiting for re-feeding is single-sided printing. Here, if it is determined here that the setting is single-sided printing, the processing proceeds to step S611, and as previously explained, the CPU 171*a* re-feeds the paper awaiting re-feeding on standby in the double-sided path 260 to the position of the secondary transfer roller 206.

Note that in step S607, the case where YES is determined is possible when after a first print job completes, for example, a second print job is executed. A paper, to which the final page of a first print job is printed, is registered as a single-sided printing paper in steps S504 and S506 of the previously described FIG. 5. When a first paper of the second print job is printed, the processing proceeds from step S602→step S606→step S607, and a paper on which a final page of the first print job that is on standby is printed is determined to be a single-sided printing paper, and the processing proceeds to step S611. In step S611, the CPU 171*a* re-feeds the final paper of the previous first print job which is waiting in the double-sided path 260 to the position of the secondary transfer roller 206, and discharges the paper.

Meanwhile, in step S607, when the CPU 171*a* determines that setting of the paper awaiting re-feeding is not single-sided printing, the processing proceeds to step S610, a paper is fed from one of the cassettes 208-211 or the manual feed tray 240, and an image is formed on the back side of the fed paper. Then, an instruction is made to the printer control unit 250 so as to convey the paper to the double-sided path 260, and the processing proceeds to step S601.

Also, when the CPU 171*a*, in step S602, determines that there does not exist a paper on the double-sided path 260 or a paper that is awaiting re-feeding, the processing proceeds to step S603, and the CPU 171*a* determines whether or not a setting of a paper in the paper feed wait queue is forcible double-sided printing. If the setting is forcible double-sided printing, the processing proceeds to step S604, and if the setting is not forcible double-sided printing, the processing advances to step S605. In step S604, the CPU 171*a* changes the setting of the paper of the paper feed wait queue to single-sided printing from the forcible double-sided printing, and the processing advances to step S609. In step S609, the CPU 171*a* feeds a paper from one of the cassettes 208-211 or the manual feed tray 240, makes an instruction to the printer control unit 250 to perform the single-sided printing and discharge the printed paper to one of the discharge orifices 252, 253, and 254, and advances the processing to step S601.

With this, after an image is formed on one side of the paper which is the target of single-sided printing by the secondary transfer roller 206, the printed paper is discharged to one of the discharge orifices 252, 253, and 254 without being sent to the double-sided path 260.

Meanwhile, when the CPU 171*a*, in step S603, determines that the setting of the paper of the paper feed wait queue is not a forcible double-sided printing, the processing proceeds to step S605, and the CPU 171*a* determines whether or not the setting of the paper of the paper feed wait queue is double-sided printing. If the CPU 171*a* determines that the setting is double-sided printing, the CPU 171*a* advances the processing to step S610, feeds a paper from one of the cassettes 208-211 or the manual feed tray 240, and forms an image on one side thereof (the back side). Then, the CPU 171*a* makes an instruction to the printer control unit 250 so as to convey the paper to the double-sided path 260, and advances the processing to step S601.

Meanwhile, if, in step S605, the CPU 171*a* determines that the setting of the paper of the paper feed wait queue is not double-sided printing, the CPU 171*a* advances the processing to step S609. In step S609, the CPU 171*a* feeds a paper from one of the cassettes 208-211 or the manual feed tray 240, makes an instruction to the printer control unit 250 to perform the single-sided printing and discharge the printed paper to one of the discharge orifices 252, 253, and 254, and advances the processing to step S601. With this, after an image is formed on one side of the paper for which the setting is not double-sided printing, the paper is discharged to one of the discharge orifices 252, 253, and 254 without being sent to the double-sided path 260.

The processing of step S610 here is executed when an image is first formed on one side of a paper of a double-sided print setting when the number of papers sent to the double-sided path 260 and waiting is less than or equal to the predetermined number of papers.

The processing of step S609 is executed when an image is formed on one side of a paper of single-sided print setting when the number of papers sent to the double-sided path 260 and waiting is less than or equal to the predetermined number of papers.

Furthermore, the processing of step S611 corresponds to a state when there is no paper that is awaiting feeding, that is a state in which the paper of the number 8 in the Table 6 which is explained later, for example, is fed, and there is no paper to feed thereafter. This corresponds to a case in which the papers of the numbers 6-8 on which images are respectively already formed on the back side and which are awaiting re-feeding are re-fed and images are respectively formed on the front side thereof. Also, this corresponds to a case where, for example, at a conveyance timing 7 in the Table 6 where the number of paper awaiting re-feeding is 3 or more, a paper of the number 4 at the head which is awaiting re-feeding is re-fed from the double-sided path 260 to the transfer position, and an image based on the print data of page 6 is formed on the front side thereof.

By the above explained processing, when the number of papers that are sent to the double-sided path 260 and are waiting for re-feeding are a predetermined number of papers (for example, 3 papers) or more, the paper at the head which is waiting is conveyed to the transfer position, and an image is formed on the side of the paper that is not printed (the front side).

Table 4 illustrates an example in which single-sided printing and double-sided printing are mixed in the print data for which overall setting of a print job is double-sided printing. The print job includes 14 pages of image data, and illustrates that single-sided print setting is designated for the fifth page and the tenth page and double-sided printing is designated for the other pages. Here, an example is illustrated in which the pages for which single-sided printing is designated respectively emerge independently.

TABLE 4

| PAGE NUMBER | 1 | 2 | 3 | 4 | 5 | 6 | 7 |
|---|---|---|---|---|---|---|---|
| SINGLE-SIDED/ DOUBLE-SIDED DESIGNATION | DOUBLE-SIDED | DOUBLE-SIDED | DOUBLE-SIDED | DOUBLE-SIDED | SINGLE-SIDED | DOUBLE-SIDED | DOUBLE-SIDED |
| PAGE NUMBER | 8 | 9 | 10 | 11 | 12 | 13 | 14 |
| SINGLE-SIDED/ DOUBLE-SIDED DESIGNATION | DOUBLE-SIDED | DOUBLE-SIDED | SINGLE-SIDED | DOUBLE-SIDED | DOUBLE-SIDED | DOUBLE-SIDED | DOUBLE-SIDED |

Table 5 illustrates a state after the print data illustrated in Table 4 is registered, and images of the page numbers 1-4 of Table 4 have been respectively formed on both sides of the papers of the numbers 1 and 2. Here, a feed queue from the paper of the number 3 when a double-sided circulating control is interrupted because the analysis of the fifth page of print data does not keep up in the cycle of the double-sided circulating control is illustrated. For example, forcible double-sided printing is set for the paper of the number 3 in the feed queue number 1 in order to form the fifth page image for which the single-sided printing is designated, and it is set so that the image of the fifth page of the print data is formed on the front side of the paper of the number 3, and a blank image is formed for the back side of the paper.

Also, images of the sixth and seventh pages of print data are respectively formed on both sides of the paper of the number 4, and images of the eighth and ninth pages of the print data are respectively formed on both sides of the paper of the number 5. Also, the forcible double-sided printing is set for the paper of the number 6 in the feed queue number 4 in order to form the tenth page image for which the single-sided printing is designated, and it is set so that the image of the tenth page of the print data is formed on the front side of the paper of the number 6, and a blank image is formed for the back side of the paper. Furthermore, images of the eleventh and twelfth pages and the thirteenth and fourteenth pages of the print data are respectively formed in double-sided printing on the papers of the numbers 7 and 8.

TABLE 5

| FEED QUEUE NUMBER | 1 | 2 | 3 | 4 | 5 | 6 | 7 | 8 |
|---|---|---|---|---|---|---|---|---|
| PAPER NUMBER | 3 | 4 | 5 | 6 | 7 | 8 | | |
| FRONT PAGE | 5 | 6 | 8 | 10 | 11 | 13 | | |
| BACK PAGE | BLANK SHEET | 7 | 9 | BLANK SHEET | 12 | 14 | | |

TABLE 5-continued

| FEED QUEUE NUMBER | 1 | 2 | 3 | 4 | 5 | 6 | 7 | 8 |
|---|---|---|---|---|---|---|---|---|
| SINGLE-SIDED/ DOUBLE-SIDED DESIGNATION | FORCIBLE DOUBLE-SIDED | DOUBLE-SIDED | DOUBLE-SIDED | FORCIBLE DOUBLE-SIDED | DOUBLE-SIDED | DOUBLE-SIDED | | |

Table 6 illustrates an example of a print schedule in a case where the print queue illustrated in Table 5 is printed by the image forming apparatus according to the embodiment.

Next, explanation is given of an example of a case where pages for which single-sided printing is designated exist consecutively from the head of the cycle of the double-sided circulating control.

TABLE 6

| CONVEYANCE TIMING | | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| FEEDING | PAPER NUMBER | 3 | 4 | | 5 | | 6 | | 7 | | 8 | | | | | |
| | PRINT SIDE | — | BACK | | BACK | | BACK | | BACK | | BACK | | | | | |
| | PAGE NUMBER | 6 | 7 | | 8 | | | | 12 | | 14 | | | | | |
| RE-FEEDING | PAPER NUMBER | | | | | | | 4 | | 5 | | 6 | | 7 | | 8 |
| | PRINT SIDE | | | | | | | FRONT | | FRONT | | FRONT | | FRONT | | FRONT |
| | PAGE NUMBER | | | | | | | 6 | | 8 | | 10 | | 11 | | 13 |

For example, a conveyance timing 1 illustrates feeding the paper of the number 3 from any of cassettes 208-211 or the manual feed tray 240, and forming an image of the fifth page of the print data on one side of the paper of the number 3, and then discharging as is. The conveyance timing 2 illustrates feeding the paper of the number 4 to form an image in accordance with the print data of the seventh page on the back side of the paper of the number 4. Then, the paper of the number 4 is re-fed from the double-sided path 260 at the conveyance timing 7 at which time the number of papers waiting for re-feeding has become 3, and an image is formed by the print data of the sixth page on the front side of the paper of the number 4.

Also, the conveyance timing 6 illustrates feeding the paper of the number 6 to which the print data of the tenth page is printed on one side, and for which image forming is performed using image data of a blank sheet on the back side of the paper of the number 6. The paper of the number 6 is re-fed from the double-sided path 260 at the conveyance timing 11 at which time the number of papers waiting for re-feeding has become 3, and an image is formed by the print data of the tenth page on the front side of the paper of the number 6.

Table 7, similarly to the case of Table 4, is an example of print data for which overall setting of a print job is double-sided printing, where the print job includes 14 pages worth of image data. Here, the print data of the fifth page and the sixth page is single-sided print setting, and double-sided printing is designated for other pages.

TABLE 7

| PAGE NUMBER | 1 | 2 | 3 | 4 | 5 | 6 | 7 |
|---|---|---|---|---|---|---|---|
| SINGLE-SIDED/ DOUBLE-SIDED DESIGNATION | DOUBLE-SIDED | DOUBLE-SIDED | DOUBLE-SIDED | DOUBLE-SIDED | SINGLE-SIDED | SINGLE-SIDED | DOUBLE-SIDED |
| PAGE NUMBER | 8 | 9 | 10 | 11 | 12 | 13 | 14 |
| SINGLE-SIDED/ DOUBLE-SIDED DESIGNATION | DOUBLE-SIDED | DOUBLE-SIDED | DOUBLE-SIDED | DOUBLE-SIDED | DOUBLE-SIDED | DOUBLE-SIDED | DOUBLE-SIDED |

Table 8 illustrates the feed queue in a case where the print data illustrated in Table 7 is registered, the analysis of the fifth page of print data does not keep up with the cycle of the double-sided circulating control, and double-sided printing with respect to the papers of the numbers 1 and 2 completes. Here, an image is formed by the print data of the fifth page on the front side of the paper of the number 3, and an image is formed by the print data of the sixth page on the front side of the paper of the number 4. For example, forcible double-sided printing is set for the paper of the number 4 in a feed queue number 2, and setting is such that an image according to the print data of the sixth page is formed on the front side of the paper of the number 4, and a blank image is formed on the back side of the paper. Also, images of pages 7 and 8, pages 9 and 10, pages 11 and 12 and pages 13 and 14 are formed on both sides of the papers of the number 5 through to the paper of the number 8, respectively.

TABLE 8

| FEED QUEUE NUMBER | 1 | 2 | 3 | 4 | 5 | 6 | 7 | 8 |
|---|---|---|---|---|---|---|---|---|
| PAPER NUMBER | 3 | 4 | 5 | 6 | 7 | 8 | | |
| FRONT PACE | 5 | 6 | 7 | 9 | 11 | 13 | | |
| BACK PAGE | BLANK SHEET | BLANK SHEET | 8 | 10 | 12 | 14 | | |
| SINGLE-SIDED/ DOUBLE-SIDED DESIGNATION | FORCIBLE DOUBLE-SIDED | FORCIBLE DOUBLE-SIDED | DOUBLE-SIDED | DOUBLE-SIDED | DOUBLE-SIDED | DOUBLE-SIDED | | |

Table 9 illustrates an example of a print schedule in a case where in accordance with the feed queue illustrated in Table 8 printing is performed by the image forming apparatus according to the embodiment.

TABLE 9

| CONVEYANCE TIMING | | 1 | 2 | 3 | 4 | 5 | 6 | 7 | 8 | 9 | 10 | 11 | 12 | 13 | 14 |
|---|---|---|---|---|---|---|---|---|---|---|---|---|---|---|---|
| FEEDING | PAPER NUMBER | 3 | 4 | 5 | | 6 | | 7 | | 8 | | | | | |
| | PRINT SIDE | — | — | BACK | | BACK | | BACK | | BACK | | | | | |
| | PAGE NUMBER | 5 | 6 | 8 | | 10 | | 12 | | 14 | | | | | |
| RE-FEEDING | PAPER NUMBER | | | | | | | | 5 | | 6 | | 7 | | 8 |
| | PRINT SIDE | | | | | | | | FRONT | | FRONT | | FRONT | | FRONT |
| | PAGE NUMBER | | | | | | | | 7 | | 9 | | 11 | | 13 |

For example, the conveyance timing 1 illustrates feeding the paper of the number 3 from one of the cassettes 208-211 or the manual feed tray 240, and forming an image according to the print data of the fifth page for which the single-sided printing is designated. Also, the conveyance timing 2 illustrates feeding the paper of the number 4 from one of the cassettes 208-211 or the manual feed tray 240, and forming an image according to the print data of the sixth page for which the single-sided printing is designated.

Also, the conveyance timing 3 illustrates feeding the paper of the number 5 and forming an image on the back side of the paper of the number 5 by the print data of the eighth page for which the double-sided printing is designated. Image forming according to print data of a seventh page to the front side of the paper of the number 5 is executed at the conveyance timing 8 at which time the number of papers awaiting re-feeding becomes 3.

As explained above, by virtue of the image forming apparatus according to the embodiment, it becomes possible to improve productivity and prevent wear of parts by performing single-sided printing of a head image, in a case where after the cycle of the double-sided circulating control stops and the head image is an image for which single-sided printing is designated in the print data.

Other Embodiments

Embodiments of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-037297, filed Feb. 26, 2015, which is hereby incorporated by reference herein in its entirety.

What is claimed is:

1. An image forming apparatus comprising:

an image forming unit configured to form an image on a paper;

a paper feed unit configured to feed a paper from a paper supplier to the image forming unit;

a double-sided paper feed path configured to hold and convey a paper to form an image on a side that is opposite to a side of the paper on which an image has been formed;

a re-feeding unit configured to re-feed the paper held by the double-sided paper feed path to the image forming unit;

a control unit configured to control feeding of a paper to the image forming unit by the paper feed unit, and re-feeding of a paper to the image forming unit by the re-feeding unit;

a setting unit configured to, in a case where a paper for which a print setting is double-sided printing and a paper for which a print setting is single-sided printing are mixed in a print job, change the print setting of the paper that is the single-sided printing to a forcible double-sided printing that uses the double-sided paper feed path; and a changing unit configured to, if there is no paper held in the double-sided paper feed path and the print setting of a paper to be fed is the forcible double-sided printing, change the print setting of the paper to be fed into single-sided printing.

2. The image forming apparatus according to claim 1, wherein the control unit controls to, if the print setting of the print job is double-sided printing, consecutively feed a first predetermined number of papers from the paper feed unit to the image forming unit, and after a second predetermined number of papers are held in the double-sided paper feed path, perform a double-sided image formation process that alternatingly performs feeding of a paper to the image forming unit by the paper feed unit and re-feeding of a paper to the image forming unit by the re-feeding unit.

3. The image forming apparatus according to claim 2, wherein the control unit prioritizes re-feeding of a paper to the image forming unit by the re-feeding unit if the second predetermined number of papers are held in the double-sided paper feed path.

4. The image forming apparatus according to claim 2, wherein the control unit interrupts the double-sided image formation process at a paper for which the print setting is single-sided printing, and initiates the double-sided image formation process from a paper for which the print setting is double-sided printing.

5. The image forming apparatus according to claim 1, wherein a paper for which the print setting is single-sided printing is discharged after an image is formed on one side of the paper by the image forming unit.

6. The image forming apparatus according to claim 1, further comprising a unit configured to form a blank image on a side opposite to a side on which an image of the paper of the single-sided printing is formed by the forcible double-sided printing.

7. The image forming apparatus according to claim 1, wherein the control unit controls to, after image forming by the image forming unit to the paper for which the print setting is the single-sided printing, discharge the paper.

8. A method of controlling an image forming apparatus having an image forming unit configured to form an image on a paper, a paper feed unit configured to feed a paper from a paper supplier to the image forming unit, and a double-sided paper feed path configured to hold and convey a paper to form an image on a side that is opposite to a side of the paper on which an image has been formed, the method comprising:

re-feeding a paper held by the double-sided paper feed path to the image forming unit;

controlling feeding of a paper to the image forming unit by the paper feed unit and re-feeding of a paper to the image forming unit in the re-feeding;

changing the print setting of the paper that is the single-sided printing to a forcible double-sided printing that uses the double-sided paper feed path, in a case where a paper for which a print setting is double-sided printing and a paper for which a print setting is single-sided printing are mixed in a print job; and changing the print setting of the paper to be fed into single-sided printing, if there is no paper held in the double-sided paper feed path and the print setting of a paper to be fed is the forcible double-sided printing.

9. A non-transitory computer-readable storage medium storing a program for causing a computer to implement a method of controlling an image forming apparatus having an image forming unit configured to form an image on a paper, a paper feed unit configured to feed a paper from a paper supplier to the image forming unit, and a double-sided paper feed path configured to hold and convey a paper to form an image on a side that is opposite to a side of the paper on which an image has been formed, the method comprising:

re-feeding a paper held by the double-sided paper feed path to the image forming unit;

controlling feeding of a paper to the image forming unit by the paper feed unit and re-feeding of a paper to the image forming unit in the re-feeding;

changing the print setting of the paper that is the single-sided printing to a forcible double-sided printing that uses the double-sided paper feed path, in a case where a paper for which a print setting is double-sided printing and a paper for which a print setting is single-sided printing are mixed in a print job; and changing the print setting of the paper to be fed into single-sided printing, if there is no paper held in the double-sided paper feed path and the print setting of a paper to be fed is the forcible double-sided printing.

* * * * *